United States Patent [19]

Williams

[11] 4,092,805

[45] June 6, 1978

[54] APPARATUS FOR SHARPENING MICROTOME BLADES

[75] Inventor: Patrick Robert Williams, Cowes, Australia

[73] Assignee: Temtool Pty., Ltd., Australia

[21] Appl. No.: 678,916

[22] Filed: Apr. 21, 1976

[51] Int. Cl.[2] ..... B24B 3/36

[52] U.S. Cl. ..... 51/85 BS; 76/81.7

[58] Field of Search ..... 51/40, 41, 80 A, 80 BS, 51/80 B, 82 BS, 82 R, 84 BS, 84 R, 85 BS, 85 R, 86 BS, 86 R, 81 R, 81 BS; 74/206; 76/81.7, 87

[56] References Cited

U.S. PATENT DOCUMENTS

| | | | |
|---|---|---|---|
| 1,123,871 | 1/1915 | Hatfield | 51/40 |
| 1,143,383 | 6/1915 | Green | 51/86 BS |
| 1,480,791 | 1/1924 | Stein | 51/85 R |
| 1,519,661 | 12/1924 | Brix | 51/86 R X |
| 1,594,827 | 8/1926 | Fix | 51/81 BS |
| 2,060,600 | 11/1936 | Weiss | 76/87 |
| 2,986,850 | 6/1961 | Batchelder | 51/40 |
| 3,718,050 | 2/1973 | Verhellen | 74/206 |
| 3,895,462 | 7/1975 | Garin | 51/85 BS |

*Primary Examiner*—Harold D. Whitehead
*Assistant Examiner*—Nicholas P. Godici
*Attorney, Agent, or Firm*—Holman & Stern

[57] ABSTRACT

Apparatus for sharpening microtome blades comprises a frame and a horizontally sliding carriage reciprocated on the frame by a drive motor and chain drive. The frame carries a high speed motor and a low speed motor which can be selectively coupled to strops and the carriage has a clamp member to clamp a microtome blade for engagement by the strops.

2 Claims, 4 Drawing Figures

APPARATUS FOR SHARPENING MICROTOME BLADES

BACKGROUND OF THE INVENTION

This invention relates to means for sharpening microtome blades, which blades are normally used for obtaining tissue or other sections for laboratory examination.

Microtome blades consist of a wedge of steel, tungsten carbide or other hard material normally having a maximum thickness of 1½ inches which taper to a sharp edge. The blades may normally have a width of up to 2½ inches and a length of up to 20 inches.

Conventional sharpening techniques normally consisted of lapping each side of the wedge on a rotating or reciprocating rigid plate of hard material which was charged with a suitable lapping compound. Because of the need to obtain a fine edge very fine particle size abrasives were necessary and because of this the cutting action during sharpening was very slow. In fact where a blade had suffered severe damage the lapping time could be up to 8 hours. Also because the lapping consisted of two hard bodies in contact the cutting was dependent on the angle of the blade relative to the plate and also to the pressure. It was found that the angle or pressure were incorrect there was a tendency for a burr to form on the edge of the blade which burr was most desirable when the blade was in use. Also because of wear in the lapping plate and the sensitivity of the blade to location it was difficult to get repeatable performances in sharpening.

In order to overcome or minimize these difficulties the machine described in our Australian Patent No. 400,050 was developed. This machine has two sets of opposed meshing and spaced discs of which one set is a honing or grinding set and the other set is a polishing set. In use of this machine the blade to be sharpened was traversed across the point of intersection of the honing discs to partly resharpen the blade and then the required final finish was obtained by moving the blade along the point of intersection of the polishing discs. The sharpening process and apparatus of our previous invention was such as to allow a major percentage of the material to be removed to be removed by the grinding discs whereby speeding the sharpening process substantially.

This was substantial improvement on the previously proposed arrangement but still suffered from a disadvantage in that any mismatching between the location of the discs could affect the edge finally obtained on the blade.

SUMMARY OF THE INVENTION

The present invention relates to a new apparatus for sharpening microtome blades which minimizes this difficulty.

The invention includes a carrier for a blade, a carriage moveable in a direction spaced from the carrier along the length thereof, the carriage carrying at least a pair of discs which intermesh and overlap and which can be selectively driven, at two speeds, the blade carrier having means whereby its angular position can be altered so that a blade in the carrier can be brought selectively into contact with one or other of the discs.

Preferably the discs are driven by two motors, one a high speed motor and the other a low speed motor, means being provided to disengage the motor not required.

Also preferably a cutting compound can be applied to the blade or the strops

BRIEF DESCRIPTION OF THE DRAWINGS

In order that the invention may be more readily understood we shall describe one embodiment in relation to the accompanying drawings.

DETAILED DESCRIPTION OF PREFERRED EMBODIMENT

Figure 1:
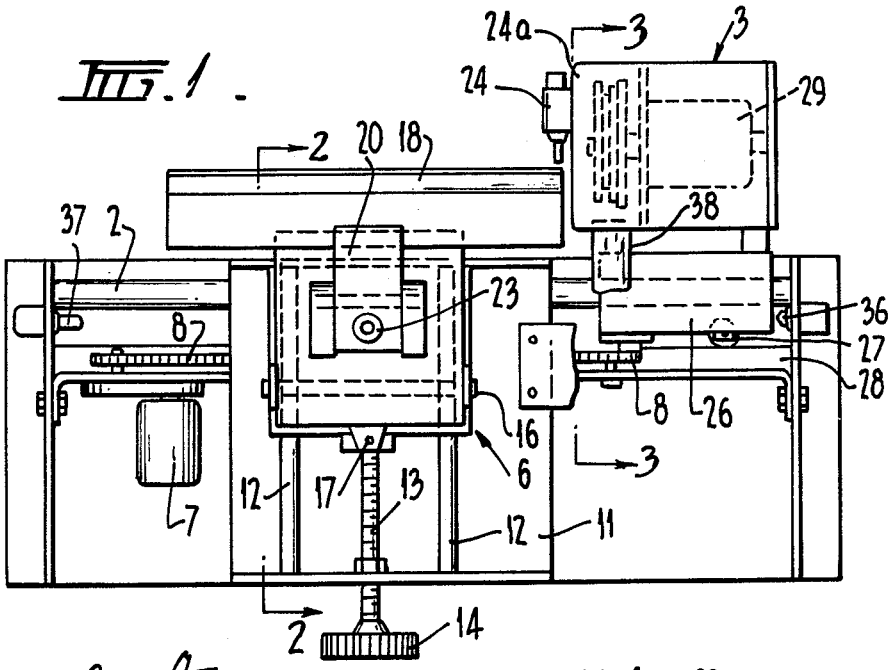
FIG. 1 shows a plan view of the apparatus of the invention with the carriage at one end of its movement.

The apparatus has a frame 1 which has extending therealong a rod or bar 2 with which is associated a carriage 3, the carriage carrying strops 4,5. Also mounted on the main frame is a blade carrier assembly 6 by means of which the correct orientation of the blade can be achieved. Also mounted on the frame is a drive motor 7 which drives a chain drive 8 which can cause the carriage 3 to be moved from one end of the frame to the other and return.

The frame will not be described further but the arrangement must be sufficiently rigid to ensure that the relationship between the carriage 3 and the blade holder 6 is correctly maintained so that as the carriage moves along a blade held in the blade holder is at all times at a true right angle to the strops.

The blade holer 6 may include a body 10 which can be relatively heavy and which can sit in a metal pan 11. This holder may be provided with a pair of apertures there through into which apertures rods 12 pass, the rods serving to guide the body when it is being moved across the pan.

Movement is by means of a screw 13 having a hand wheel 14 thereon, the screw being connected to the body 10 in such a way that rotation of this screw 13 causes the body to move across the pan guided by the rods 12.

If required, a locking member, not illustrated, can be provided to hold the blade carrier in any required position.

Mounted on the body 10 is the actual blade carrier 15. This blade carrier is mounted above pivots 16 and is associated with a solenoid or the like which is not illustrated but has an arm 17 connected to the holder 15. Operation of the solenoid moves the holder between two positions, the first of which being the position where its inner end rests against the body 10, the position shown in FIG. 2 to a second position indicated by a centre line in FIG. 2 where its outer end rests against the body.

Figure 2:
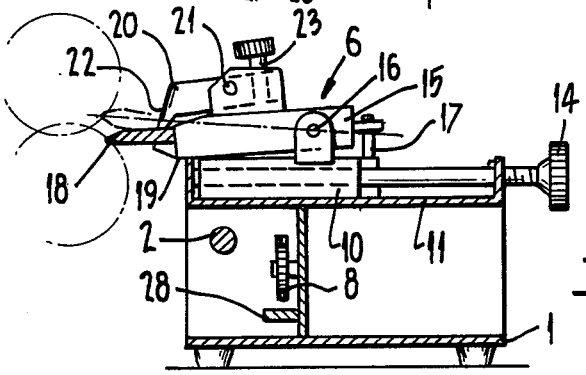
FIG. 2 is a section along line 2—2 of FIG. 1 and shows the blade carrier, the figure also showing the arrangement whereby each side of the blade can be sharpened.

As can be seen from FIG. 2 and as will become clear from the later description herein, in the first position the lower portion of the blade contacts one of the strops and in the second position the upper portion of the blade contacts the other.

The blade 18 is clamped in a recess 19 in the inner end of the carrier 15 and, as illustrated, the clamping may be by means of a clamp member 20 which is mounted about the pivot 21 and has an inner end 22 which can bear upon the blade when a screwed hand member 23 is tightened.

The arrangement is such that by manipulation of the hand wheel 14 the blades position relative to the strops can be varied to ensure that it is in an optimum position and the achievement of this can, if required, be controlled by the location of a micrometer 24 on the side of the carriage, which micrometer can be set for the required blade position and the blade thereagainst.

The carriage assembly 3 has a body portion 24*a* in which are located the strops 4, 5 and their associated motors and a control and drive portion 25 which maintains the location of the body portion 24*a* and, at the same time, permits it to be moved across the length of the machine.

The control portion 25 comprises a relatively massive block 26 which has a central aperture of approximately the same diameter of the rod 2 and is fitted thereabouts. On the side away from the body portion 24*a* the block 26 is connected directly to the chain 8. Extending below the massive block 26 there is an idler wheel 27 which abuts a rail 28 connected to the body of the machine.

The carriage may thus be free to rotate a certain distance about the rod 2 but because of the moment caused by the body portion 24*a* the idler roller 27 is held against the rail 28 and positioning is maintained.

In the body portion 24*a* there are located two motors, a universal motor 29 which can be adapted to operate at some 6,000 r.p.m., and a low speed motor 30 which may be low speed synchronous motor which operates at, say, 15 r.p.m. Associated with the motor 30 is a solenoid 31 which can engage or disengage motor 30 from its shaft 32. The reason for this is that when the motor 29 is operating it is most undesirable to have motor 30 engaged as the motor is not designed for the speeds at which motor 29 operates, but when motor 30 is operating motor 29 can be driven as low speeds will do no damage to this motor.

The motor shafts 32, and 33 each carry one of strops 5, 4, respectively and each also have a tyre 34, 35 which tyres are in constant frictional connection so that when either motor is operating its associated tyre causes a contra-rotation of the other strop, the strops rotating at the same speed.

Figure 3:
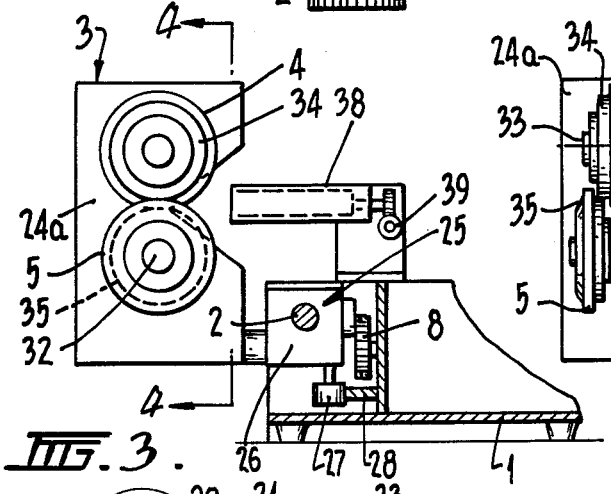
FIG. 3 is a section along line 3—3 of FIG. 1 and shows the relative positioning of the carriage to the machine frame and also shows the means whereby cutting material can be applied to the strops.
Figure 4:
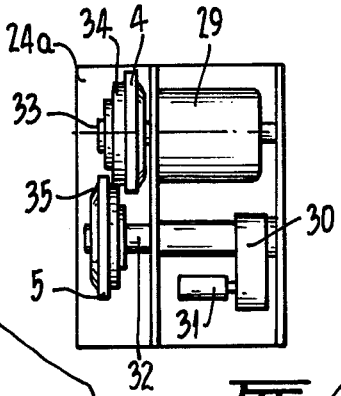
FIG. 4 is a view along line 4–of FIG. 3 and shows the relationship between the two strops and their motors.

The strops themselves are, as can be seen, located one above the other, spaced from one another and they overlap, see particularly FIG. 3. Thus in side elevation there is a substantially V-shaped nip between the two strops.

The material from which the strops are made can be any material known in the art, and they may preferably be of a fabric.

Mounted on the frame there are a pair of reversing switches 26, 27 which are interconnected to alter the direction of rotation of motor 7 whenever the carrier 3 comes to one end of its movement.

Also mounted on the frame there is a dispenser 38 for a lipstick type honing compound, the compound being delivered by manipulation of a hand wheel 39 which may comprise a worm drive operating on worm wheel controlled screw which in turn causes delivery of the honing compound.

The position of the compound is so located that as the strops pass the dispenser 38 they pick up a small quantity of compound which is later applied to the blade being sharpened.

I claim:

1. Apparatus for sharpening blades including a carrier for a blade, a carriage moveable in a direction spaced from the carrier, along the length thereof, the carriage carrying at least one pair of disc stops which are side by side and overlapping and which can be selectively driven at two speeds, the blade carrier having means whereby its angular position can be altered so that a blade in the carrier can be brought, selectively, into contact with one or other of the strops, wherein associated with each strop there is a wheel having a surface of a material having high frictional characteristics, the wheel interengaged to drive the strops in a contra-rotating manner, wherein each strop is associated with a motor, one of the motors being a high speed motor to enable forming of the blade and the other being a low speed motor to enable the blade to be polished.

2. The apparatus as claimed in claim 1 wherein the low speed motor has a clutch whereby it is only connected to its associated strop when it is driving the strops.

* * * * *